United States Patent [19]

Beck et al.

[11] 4,339,196

[45] Jul. 13, 1982

[54] ECCENTRIC CAM FOR ELECTROPHOTOCOPIER DEVELOPER UNIT

[75] Inventors: Christian A. Beck, Ridgefield; Paul J. Macaluso, Norwalk, both of Conn.

[73] Assignee: Pitney Bowes Inc., Stamford, Conn.

[21] Appl. No.: 210,977

[22] Filed: Nov. 28, 1980

[51] Int. Cl.[3] ..... G03G 15/00; G03G 15/02

[52] U.S. Cl. ..... 355/3 DD; 355/3 R; 355/14 D; 118/657; 118/658

[58] Field of Search ..... 355/3 R, 3 DD, 4, 14 DD, 355/14 R; 118/644, 651, 653, 657, 658

[56] References Cited

U.S. PATENT DOCUMENTS

| | | | |
|---|---|---|---|
| 3,357,325 | 12/1967 | Eichurn et al. | 95/1.7 |
| 3,462,217 | 8/1969 | Tregay et al. | 355/14 |
| 3,924,944 | 12/1975 | Smith et al. | 355/3 DD |
| 3,957,367 | 5/1976 | Goel | 355/4 |
| 3,970,042 | 7/1976 | Rees | 355/4 X |
| 4,087,168 | 5/1978 | Fraser | 355/3 R X |
| 4,097,139 | 6/1978 | Hauser et al. | 355/4 |
| 4,294,534 | 10/1981 | Snelling | 355/3 R |

*Primary Examiner*—Arthur C. Prescott

*Attorney, Agent, or Firm*—Lawrence E. Sklar; Martin D. Wittstein; William D. Soltow, Jr.

[57] ABSTRACT

An improvement in an electrophotocopying machine having a photoconductive surface and a retractable, pivotably mounted developer unit for developing an electrostatic image on the photoconductive surface. The improvement comprises at least one eccentric cam for moving said developer unit into and out of developing engagement with said photoconductive surface, said cam having a curved, cantilevered arm extending therefrom, said arm increasing the effective radius of said cam starting from the junction of the arm with the cam to the end of the arm remote from said junction, and means for reciprocally rotating said cam whereby said cam moves said developer unit into and out of developing engagement with said photoconductive surface.

6 Claims, 4 Drawing Figures

10
12
14
16
18
20
22
23
24
26
28
29
30
32
34
35
36
37
38
39
40
42
44
46
48
50
52
54
56
R1
R2
4

ECCENTRIC CAM FOR ELECTROPHOTOCOPIER DEVELOPER UNIT

BACKGROUND OF THE INVENTION

The instant invention relates to electrophotocopying machines in general, and more particularly to a camming system for moving a developer unit into and out of developing engagement with a photoconductive surface.

In electrophotocopying, as typified by xerography, it is usual to form an electrostatic image on a photoconductive surface conforming to the original document being reproduced. This image is then developed or made visible by the application of an electrostatically attractable material which is deposited in conformity with the latent electrostatic image.

In xerographic development systems, especially those employing single component developer material, a uniform development zone between the developer unit applicator roller and the photoreceptor is essential to consistent latent image development. Because the photoreceptor experiences certain deviations from its nominal location due to mechanical tolerances of its support member, it becomes necessary to either rotate the developer unit about a point or translate the unit through a plane such that the developer unit will follow the mechanical runout of the photoreceptor. A further complication appears in some systems, whereby extended interfacing of the developer unit with the photoreceptor under certain conditions (e.g. overnight) results in migration onto the surface of the photoreceptor. Upon machine activation, this effect allows a quantity of developer material on the photoreceptor surface to be transported to the roll transfer station (if utilized) and the photoreceptor cleaning station. After a number of machine cycles have been completed, the imposition of this additional developer material may contribute to premature failure of the interfacing system. To alleviate this condition, a mechanism must be added to engage and withdraw the developer unit from the photoreceptor. A typical device for moving the developer unit into and out of developing engagement with the photoreceptor is disclosed in U.S. Pat. No. 3,743,407 issued July 3, 1973.

The instant invention achieves the same result of moving the developer unit into and out of developing engagement with the photoreceptor as the prior art devices, but it does so without the need for any engagement springs, spring securing pins or two-way solenoids to move the developer unit.

SUMMARY OF INVENTION

Accordingly, the instant invention provides an improvement in an electrophotocopying machine having a photoconductive surface and a retractable, pivotably mounted developer unit for developing an electrostatic image on the photoconductive surface. The improvement comprises at least one eccentric cam for moving the developer unit into and out of developing engagement with the photoconductive surface, the cam having a curved, cantilevered arm extending therefrom, the arm increasing the effective radius of the cam starting from the junction of the arm with the cam to the end of the arm remote from the junction, and means for reciprocally rotating the cam whereby the cam moves the developer unit into and out of developing engagement with the photoconductive surface.

DETAILED DESCRIPTION

Figures 1, 2, 3, 4:
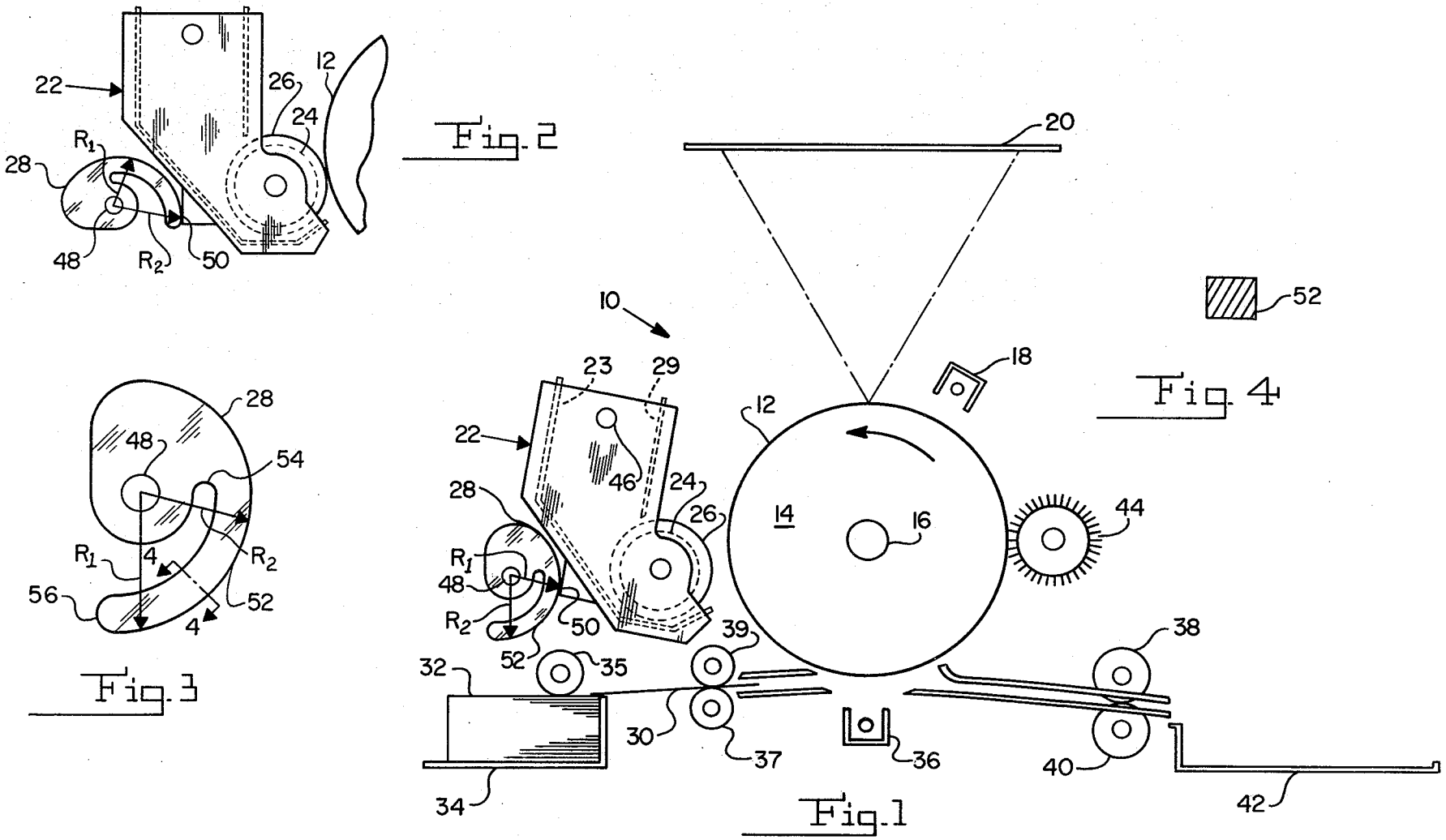
FIG. 1 is a side, elevational view in schematic form of an eccentric cam in an electrophotocopying machine according to the instant invention, wherein the developer unit is out of developing engagement with the photoconductor.
FIG. 2 is a partial, side, elevational view in schematic form similar to FIG. 1 except that the developer unit is shown in developing engagement with the photoconductor.
FIG. 3 is an englarged, side elevational view of the eccentric cam seen in FIGS. 1 and 2.
FIG. 4 is a sectional view taken on the plane indicated by the line 4—4 in FIG. 3.

In describing the preferred embodiment of the instant invention, reference is made to the drawings, wherein the basic components of a plain paper photocopying machine generally designated 10 are shown in FIG. 1. The photocopying machine 10 includes a re-usable photoconductor 12 secured to a drum 14 mounted on a shaft 16. Situated around the photoconductor 12 are a number of operating stations. At about the 1 o'clock position is situated a charging corona 18. The original document to be copied (not shown) rests upon a transparent platen 20 and is preferably scan exposed upon the 12 o'clock portion of the photoconductor 12 in conventional manner to thereby form a latent electrostatic image on the charged photoconductor 12. A developer unit 22 having a storage hopper 23 is located at a 9 o'clock position with respect to the photoconductor 12, and includes a magnetic brush 24 for applying toner material (typically single component) to the latent electrostatic image on the photoconductor 12. At either end of the magnetic brush 24 are a pair of spacer wheels 26 which ride adjacent the photoconductor 12 on the drum 14 supporting the photoconductor 12. A pair of eccentric cams 28 (only one of which is shown), to be discussed in further detail hereinbelow, are also provided in order to move the developer unit 22 into and out of developing engagement with the photoconductor 12. The developer unit 22 also includes a doctor blade 29 for removing excess toner material from the magnetic brush 24. A copy sheet 30 is fed from a supply of copy sheets 32 in a feeding tray 34 by a feed roller 35 towards a pair of feed rollers 37 and 39 which in turn feed the copy sheet 30 to a transfer corona 36 which functions to transfer the developed image from the photoconductor 12 to the copy sheet 30 in conventional manner. The copy sheet 30 bearing the toned image is then fed to a pair of pressure fixing rollers 38 and 40 which fuse the toned image in conventional manner to the copy sheet 30. The copy sheet 30 then exits into a receiving tray 42 where it may be retrieved by the operator. Prior to the next copy cycle, the photoconductor 12 is cleaned by a conventional, continuous wiping roller 44.

In order that the developer unit 22 may be moved into and out of developing engagement with the photoconductor 12, the developer device is pivotably mounted on a shaft 46 with respect to the photoconductor 12 such that, in its free body state, it remains spaced from the photoconductor 12 as seen in FIG. 1. The eccentric cams 28 are also fixedly mounted on the ends of a rotatable shaft 48 and engage a vertical, abutting surface 50 of the developer unit 22. More specifically, the cams 28 are positioned such that the developer unit 22 rests on the cam surface of small radius R1 and away from the photoconductor 12. When it is desired to move the developer unit 22 into developing engagement with the photoconductor 12 the shaft 48 and the eccentric cams 28 are rotated counterclockwise a predetermined amount by a rotary solenoid or motor (not shown) in such fashion that the cam profile allows a controlled engagement of the developer unit 22 with the photoconductor 12, thereby avoiding the usual abrupt motion associated with electrical components. The change of R1 to R2 allows the developer unit 22 to be engaged with the photoconductor 12 while the curved, cantilever arms 52 (only one of which is shown) provide compensation for motion experienced due to mechanical runouts created by accumulation of tolerance in the photoconductor support means and developer unit spacer wheels 26. When it is desired to move the developer unit 22 out of developing engagement with the photoconductor 12, the shaft 48 and eccentric cams 28 are rotated clockwise.

As best seen in FIG. 3, each eccentric cam 28 includes a curved, cantilevered arm portion 52 which serves to increase the effective radius of the cam 28 starting from the junction 54 of the arm 52 with the cam 28 to the end 56 of the arm 52 remote from the junction 54. The load to be applied by each cam 28 against the surface 50 can be tailored by means of the material used for the arm 52 and a variation in the cross sectional configuration of the arm 52, or by varying the side elevational configuration (width) of the arm 52, so that, for example, the end 56 of the arm 52 is wider than at the junction 54. It is easiest to maintain a constant cross section and to increase the width of the arm 52. Just exactly how much R2 will increase with respect to R1 depends upon the modulus of elasticity, deflection and cross sectional area of the arm 52.

While the present invention has been described with the reference to the particular structure disclosed herein, it is not intended that it be limited to the specific details and this application is intended to cover such modifications or changes as may come within the purposes of the improvements or scope of the claims forming a part hereof.

What is claimed is:

1. In an electrophotocopying machine having a photoconductive surface and a retractable, pivotably mounted developer unit for developing an electrostatic image on the photoconductive surface, the improvement comprising at least one eccentric cam for moving said developer unit into and out of developing engagement with said photoconductive surface, said cam having a curved, cantilevered arm extending therefrom, said arm increasing the effective radius of said cam starting from the junction of the arm with the cam to the end of the arm remote from said junction, and means for reciprocally rotating said cam whereby said cam moves said developer unit into and out of developing engagement with said photoconductive surface.

2. The improvement of claim 1, wherein there are a pair of cams located at either end of the developer unit.

3. The improvement of claim 2, wherein the developer unit employs single component developer material.

4. The improvement of claim 3, wherein the photoconductive surface is mounted on a drum.

5. The improvement of claim 4, wherein the developer unit includes a magnetic brush for applying developer material to the electrostatic image.

6. The improvement of claim 5, additionally comprising a pair of spacer wheels situated at either end of the magnetic brush, said wheels able to ride on the drum adjacent the photoconductive surface.

* * * * *